US007703868B2

(12) United States Patent
Junhua

(10) Patent No.: US 7,703,868 B2
(45) Date of Patent: Apr. 27, 2010

(54) METHOD FOR DETECTING PRINTING MATERIAL AMOUNTS IN PRINTING MATERIAL CONTAINER ATTACHED TO PRINTER

(75) Inventor: Zhang Junhua, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 356 days.

(21) Appl. No.: 11/808,177

(22) Filed: Jun. 7, 2007

(65) Prior Publication Data

US 2008/0007577 A1 Jan. 10, 2008

(30) Foreign Application Priority Data

Jun. 7, 2006 (JP) ..... 2006-158243

(51) Int. Cl.
*B41J 2/195* (2006.01)
*B41J 29/393* (2006.01)
*B41J 2/175* (2006.01)

(52) U.S. Cl. ..... 347/7; 347/19; 347/86

(58) Field of Classification Search ..... 347/19, 347/86, 7
See application file for complete search history.

(56) References Cited

FOREIGN PATENT DOCUMENTS

JP 2003-39707 A 2/2003

*Primary Examiner*—Julian D Huffman
(74) *Attorney, Agent, or Firm*—Sughrue Mion, PLLC

(57) ABSTRACT

The amount of ink is determined using both a first vibration frequency that is measured when a driving signal of a first frequency is provided to a sensor, and a second vibration frequency that is measured when a driving signal of a second frequency, which is less than the first vibration frequency by a specific ratio, is provided to the sensor. When there is an incorrect measurement of either the first vibration frequency or the second vibration frequency, the natural frequencies to which the vibration frequencies are near will be different. Because the cases wherein the vibration frequency is measured incorrectly are the cases wherein there in no ink, when the first vibration frequency and/or the second vibration frequency is near to the target natural frequency, it is determined that the amount of ink is stored in the cartridge being processed is less than a specific amount.

3 Claims, 11 Drawing Sheets

INK FULL

CROSS SECTION A-A

INK END

CROSS SECTION A-A

Fig.7A

FIRST FREQUENCY F1 500

| STATUS OF INK CARTRIDGE | | AMPLITUDE OF THE RESPONSE SIGNAL |
|---|---|---|
| AMOUNT OF CHANGE IN THE NATURAL FREQUENCY | AMOUNT OF INK | |
| SMALL | INK FULL | ADEQUATE |
| | INK END | ADEQUATE |
| LARGE | INK FULL | ADEQUATE |
| | INK END | INADEQUATE |

Fig.7B

SECOND FREQUENCY F2 510

| STATUS OF INK CARTRIDGE | | AMPLITUDE OF THE RESPONSE SIGNAL |
|---|---|---|
| AMOUNT OF CHANGE IN THE NATURAL FREQUENCY | AMOUNT OF INK | |
| SMALL | INK FULL | ADEQUATE |
| | INK END | INADEQUATE |
| LARGE | INK FULL | ADEQUATE |
| | INK END | ADEQUATE |

600

| COMBINATION NUMBER | DEAREST TARGET NATURAL FREQUENCY | | INK AMOUNT OF DETERMINATION RESULT |
|---|---|---|---|
| | VF1 | VF2 | |
| 1 | H1 | H1 | MORE THAN THE SPECIFIC AMOUNT |
| 2 | H1 | H2 | LESS THAN THE SPECIFIC AMOUNT |
| 3 | H2 | H1 | LESS THAN THE SPECIFIC AMOUNT |
| 4 | H2 | H2 | LESS THAN THE SPECIFIC AMOUNT |

Fig.12

43a

| RANK | RANGE OF A VIBRATION FREQUENCIES | DRIVING SIGNAL FREQUENCY (KHZ) | |
|---|---|---|---|
| | | F1(n) | F2(n) |
| A | Amin≦HE<Amax | Fa1 | Fa2 |
| B | Bmin≦HE<Bmax | Fb1 | Fb2 |
| C | Cmin≦HE<Cmax | Fc1 | Fc2 |
| D | Dmin≦HE<Dmax | Fd1 | Fd2 |
| E | Emin≦HE<Emax | Fe1 | Fe2 |

METHOD FOR DETECTING PRINTING MATERIAL AMOUNTS IN PRINTING MATERIAL CONTAINER ATTACHED TO PRINTER

CROSS-REFERENCE TO RELATED APPLICATIONS

The present application claims the priority based on Japanese Patent Application No. 2006-158423 filed on Jun. 7, 2006, the disclosure of which is hereby incorporated by reference in its entirety.

BACKGROUND

1. Technical Field

The present invention relates to printers, and, in particular, relates to methods for detecting printing material amounts in printing material containers attached to printers.

2. Related Art

Ink containers attached to ink-spray printers are provided with sensors for detecting the amount of remaining ink, such as piezoelectric elements having the characteristics of expanding and contracting when a voltage is applied. Because piezoelectric elements generate a residual vibration after a voltage has been applied and then output an output signal by this residual vibration, when the amount of ink is detected using a sensor provided with a piezoelectric element, the printer is able to determine whether there is ink remaining in an ink container by applying a voltage to the piezoelectric element and measuring the frequency of the output a signal that is outputted from the sensor. Specifically, the printer is able to determine whether t the ink remaining in the ink container is more than a specific amount by measuring the vibration frequency of the sensor included in the output signal.

The measurement accuracy of the vibration frequency is able to be improved by increasing the amplitude of the vibration of the sensor by having the frequency of the voltage that is applied to the piezoelectric element be the natural frequency of the sensor.

However, the natural frequency of the sensor may change depending on a variety of factors. For example, there are changes caused by the ink that is adhered to the sensor when the ink stored in the ink container remains in the ink container at less than a specific amount, and changes caused by damage to the sensor part in the ink container. When the natural frequency changes, the accuracy of the measured vibration frequency drops because it is not possible to obtain an adequate amplitude in the vibration of the sensor. As a result, the accuracy of the measurement of the ink volume reduces.

SUMMARY

The present invention is implemented in view of the above problems, and the purpose thereof is to improve the accuracy of the determination of the amount of ink stored in the ink container.

In order to address at least part of the problem described above, a first aspect of the present invention provides, a printer that measures the amount of printing material, of printing material stored in a printing material container.

The printer in accordance with the first aspect of the present invention is characterized by having a printing material container attached removably, wherein the printing material container comprises a detector and a memory, wherein the detector detects the amount of printing material stored in the container using a piezoelectric element, wherein the memory stores frequency information regarding frequency of a driving signal for driving the detector, comprising:

a frequency information acquiring module that acquiring the frequency information from the memory;

a frequency acquiring module that acquires first frequency and second frequency based on the acquired frequency information, wherein the first frequency is lower, by a fixed ratio, than a first natural frequency, wherein the first natural frequency is the natural frequency of the detector when the printing material is stored at more than a specific amount in the printing material container, wherein the second frequency is lower than the first frequency;

a providing module that provides a first driving signal and a second driving signal to the piezoelectric element with different timings, wherein the first driving signal has a first frequency and the second driving signal has a second frequency;

a detecting module that detects a first response signal and a second response signal, wherein the first response signal is outputted from the detector in accordance with vibration of the piezoelectric element after the provision of the first driving signal stops, and the second response signal is outputted from the detector in accordance with vibration of the piezoelectric element after the provision of the second driving signal stops;

a measuring module that measures first vibration frequency and a second vibration frequency, wherein the first vibration frequency is included in the first response signal, wherein the second vibration frequency is included in the second response signal; and a determining module that determines the amount of the printing material stored in the printing material container based on at least one of the first vibration frequency and the second vibration frequency.

According to the printer of the first aspect of the present invention, it is able to determine the amount of the printing material stored in the printing material container by referencing a first vibration frequency that is measured using a driving signal having a first frequency, and referencing a second vibration frequency that is measured using a driving signal that has a second frequency that is lower than the first frequency. The printer in accordance with the present invention is able to improve the accuracy of the determination of the amount of printing material, even when the natural frequency of the printing material container has changed.

A second aspect of the present invention provides a printer that measures the amount of printing material, of the printing material stored in the printing material container. The printer of the second aspect of the present invention is characterized by having a printing material container attached removably to the printer, wherein the printing material container comprises a detector and a memory, wherein the detector detects the amount of printing material stored in the printing material container using a piezoelectric element, and the memory stores a first frequency and a second frequency, wherein the first frequency is lower, by a fixed ratio, than a natural frequency of the detector when less than the specific amount of printing material is stored in the printing material container, and the second frequency is lower than the first frequency, the printer comprising:

an acquiring module that acquires the first frequency and the second frequency from the memory;

a providing module that provides a first driving signal and a second driving signal to the piezoelectric element with different timings, wherein the first driving signal has a first frequency and the second driving signal has a second frequency;

a detecting module that detects a first response signal and a second response signal, wherein the first response signal is outputted in accordance with the vibration of the piezoelectric element after the provision of the first driving signal stops, wherein the second response signal is outputted in accordance with the vibration of the piezoelectric element after the provision of the second driving signal stops;

a measuring module that measures a first vibration frequency of the piezoelectric element and a second vibration frequency of the piezoelectric element, wherein the first vibration frequency is included in the first response signal, wherein the second vibration frequency is included in the second response signal; and determining module that determines the amount of the printing material stored in the printing material container based on at least one of the first vibration frequency and the second vibration frequency.

The printer in accordance with the second aspect of the present invention is able to acquire the first frequency and the second frequency using a simple structure because the first frequency and the second frequency themselves are stored in the memory. Consequently, the use of the printer in accordance with the second aspect of the present invention is both able to reduce the time required for the process of determining the amount of ink, and able to increase the accuracy of the determination.

A third aspect of the present invention provides a printer that measures the amount of printing material, of the printing material stored in the printing material container. The printer in the third aspect of the present invention is characterized by having a printing material container attached removably to the printer, wherein the printing material container comprises a detector and a memory, wherein the detector detects the amount of printing material stored in the printing material container using a piezoelectric element, wherein the memory stores frequency information regarding the frequency of a driving signal for driving the detector, the printer comprising:

a frequency information acquiring module that acquires the frequency information from the memory;

a frequency acquiring module that acquires first frequency and second frequency based on the acquired frequency information, wherein the first frequency is 1/(2k+1) times (where k is any given positive integer greater than 0) vibration frequency that is lower by $\alpha$% (where $\alpha>0$) than a reference natural frequency, wherein the reference natural frequency is the natural frequency of the detector when the printing material is stored at less than a specific amount in the printing material container, wherein the second frequency is 1/(2k+1) times vibration frequency that is lower by $\beta$% (where $\beta>\alpha>0$) than the reference natural frequency;

a providing module that provides a first driving signal and a second driving signal to the piezoelectric element with different timings, wherein the first driving signal has a first frequency and the second driving signal has a second frequency;

a detecting module that detects a first response signal and a second response signal, wherein the first response signal is outputted from the detector in accordance with the vibration of the piezoelectric element after the provision of the first driving signal stops, wherein the second response signal is outputted from the detector in accordance with the vibration of the piezoelectric element after the provision of the second driving signal stops;

a measuring module that measures first vibration frequency and second vibration frequency, wherein the first vibration frequency is included in the first response signal and the second vibration frequency is included in the second response signal; and a determining module that determines the amount of the printing material stored in the printing material container based on at least one of the first vibration frequency and the second vibration frequency.

The printer in accordance with the third aspect of the present invention is able to acquire the first frequency and the second frequency with ease based on a reference natural frequency, making it possible to determine the amount of printing material that is stored in the printing material container by referencing the first vibration frequency and the second vibration frequency using the first frequency and the second frequency. Thus the printer is able to improve the accuracy of the determination of the amount of printing material even when there is a change in the value of the natural frequency of the printing material container.

A fourth aspect of the present invention provides a printing system measures the amount of printing material. The printing material stored in the printing material container.

The printing system in the forth aspect of the present invention is characterized by having a printing material container and a printer to which the printing material container is attached removably:

the printing material container comprising:

a detector that detects the amount of printing material stored in the printing material container using a piezoelectric element; and a memory that stores frequency information related to a frequency of a driving signal for driving the detector; and the printer comprising:

a frequency information acquiring module that acquires the frequency information from the memory;

a frequency acquiring module that acquires first frequency and second frequency based on the acquired frequency information, wherein the first frequency is 1/(2k+1) times (where k is any given positive integer greater than 0) vibration frequency that is lower by $\alpha$% (where $\alpha>0$) than a reference natural frequency, wherein the reference natural frequency is the natural frequency of the detector when the printing material is stored at less than a specific amount in the printing material container, wherein the second frequency is 1/(2k+1) times vibration frequency that is lower by $\beta$% (where $\beta>\alpha>0$) than the reference natural frequency;

a providing module that provides a first driving signal and a second driving signal to the piezoelectric element with different timings, wherein the first driving signal has a first frequency and the second driving signal has a second frequency;

a detecting module that detects a first response signal and a second response signal, wherein the first response signal is outputted from the detector in accordance with the vibration of the piezoelectric element after the provision of the first driving signal stops, wherein the second response signal is outputted from the detector in accordance with the vibration of the piezoelectric element after the provision of the second driving signal stops;

a measuring module that measures first vibration frequency and second vibration frequency, wherein the first vibration frequency is included in the first response signal and the second vibration frequency is included in the second response signal; and a determining module that determines the amount of the printing material stored in the printing material container based on at least one of the first vibration frequency and the second vibration frequency.

The system of the forth aspect of the present invention is able to determine the amount of printing material stored in the printing material container based on the first vibration frequency and the second vibration frequency measured using a driving signal having two different frequencies. Thus the system is able to improve the accuracy of the determination of the amount of printing material even when the natural frequency of the printing material container has changed.

These and other objects, features, aspects, and advantages of the present invention will become more apparent from the following detailed description of the preferred embodiments with the accompanying drawings.

BRIEF DESCRIPTION OF THE DRAWINGS

FIG. 7 illustrates an explanatory diagram of the tolerance range of the natural frequencies in the cartridge in the first embodiment.

FIG. 12 illustrates an explanatory diagram of a frequency table in a second embodiment.

DESCRIPTION OF THE PREFERRED EMBODIMENT

Forms of embodiment of the present invention will be explained below, based on embodiments thereof, referencing the applicable figures.

A. First Embodiment

Figure 1:
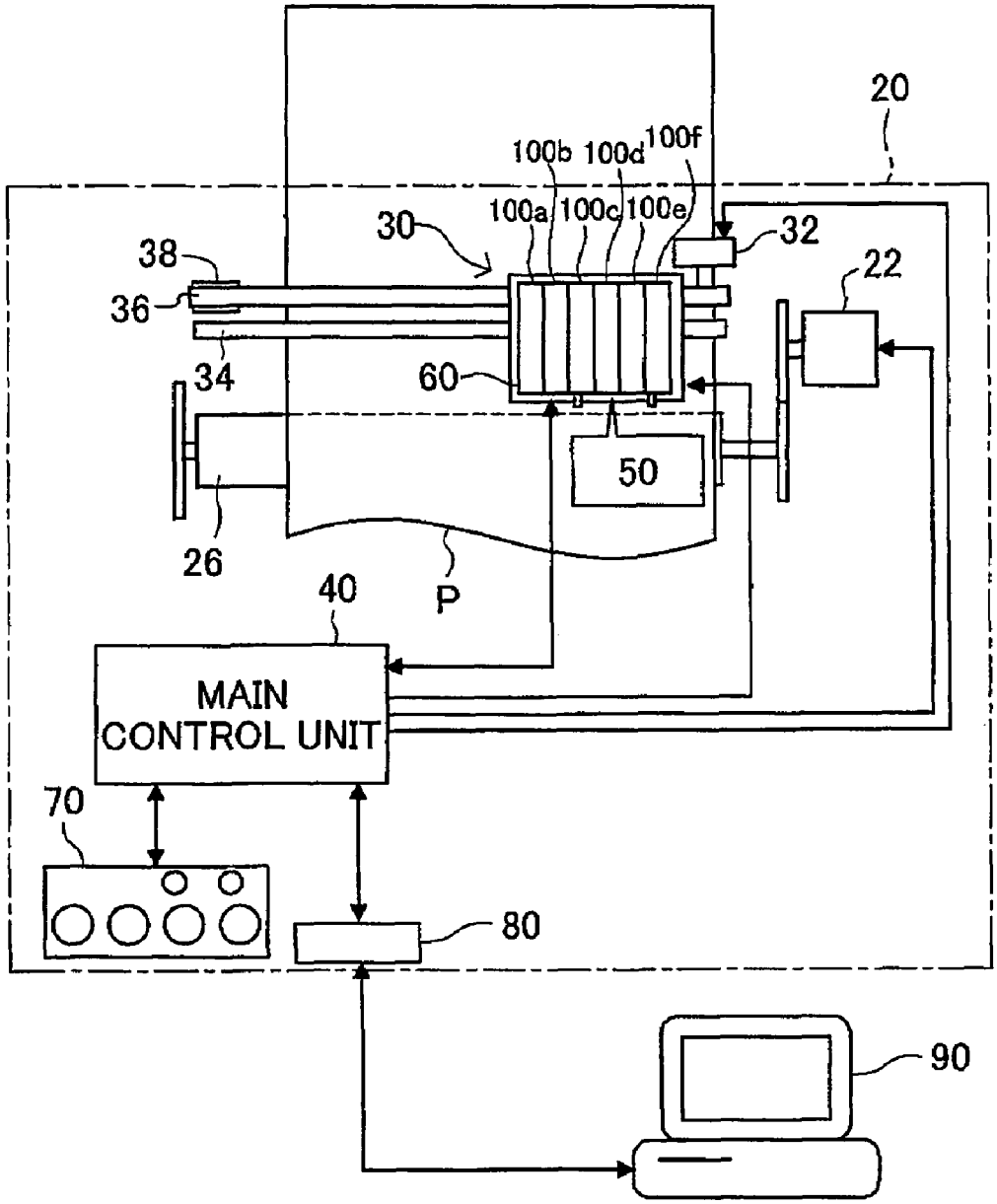
FIG. 1 illustrates an explanatory diagram of a schematic structure of a printing system according to a first embodiment.

A1. System Structure:

FIG. 1 is used to explain the basic structure of a printing system in an embodiment. FIG. 1 illustrates an explanatory diagram of the basic structure of the printing system. The printing system comprises a printer 20 and a computer 90. The printer 20 is connected to the computer 90 through a connector 80.

The printer 20 comprises a secondary scanning mechanism, a primary scanning mechanism, a head controlling mechanism, and a main controller 40 for controlling the various mechanisms. The secondary scanning mechanism comprises a paper feeding motor 22 and a platen 26. The secondary scanning mechanism feeds the paper P in the secondary scanning direction by transmitting, to the platen, the rotation of the paper feeding motor. The primary scanning mechanism comprises a carriage motor 32, a pulley 38, a driving belt 36 that stretches between the carriage motor 32 and the pulley 38, and a slide rod 34 that is disposed in parallel with the platen 26. The slide rod 34 holds, slidably, a carriage 30 attached to the drive belt 36. The rotation of the carriage motor 32 is transmitted to the carriage 30 through the drive belt 36. The carriage 30 reciprocates in the axial direction of the platen 26 (the primary scan direction) along the slide rod 34. The head controlling mechanism comprises a printing head unit 60 that is mounted on the carriage 30. the head controlling mechanism drives the printing head to expel ink onto the paper P. The printer 20 comprises an operating unit 70 that is used by the user to set a variety of printer settings and to check the printer status.

The printing head unit 60 comprises a printing head 69 and a cartridge equipping unit. The cartridge in equipping unit is equipped with six ink cartridges 100*a* through 100*f*. The printing head unit 60 further comprises a sub controller 50.

The printing head 69 includes a plurality of nozzles and a plurality of piezoelectric elements, where ink droplets are expelled from each nozzle depending on voltages applied to each of the piezoelectric elements, to form dots on the paper P. In the first embodiment, a "piezo element" is used as the piezoelectric element.

Each of the ink cartridges 100*a* through 100*f* comprises a sensor which each uses a piezoelectric element. The printer 20 provides driving signals to the piezoelectric elements of these sensors. The printer 20 determines the amount of ink stored in the ink cartridge by measuring the vibration frequency of the piezoelectric element, wherein the vibration frequency is included in a return signal that is outputted from the piezoelectric element according to the residual vibration that is produced by the piezoelectric element after the provision of the driving signal stops. Below, in the first embodiment, the "ink cartridge" shall be termed simply a "cartridge."

Figure 2:
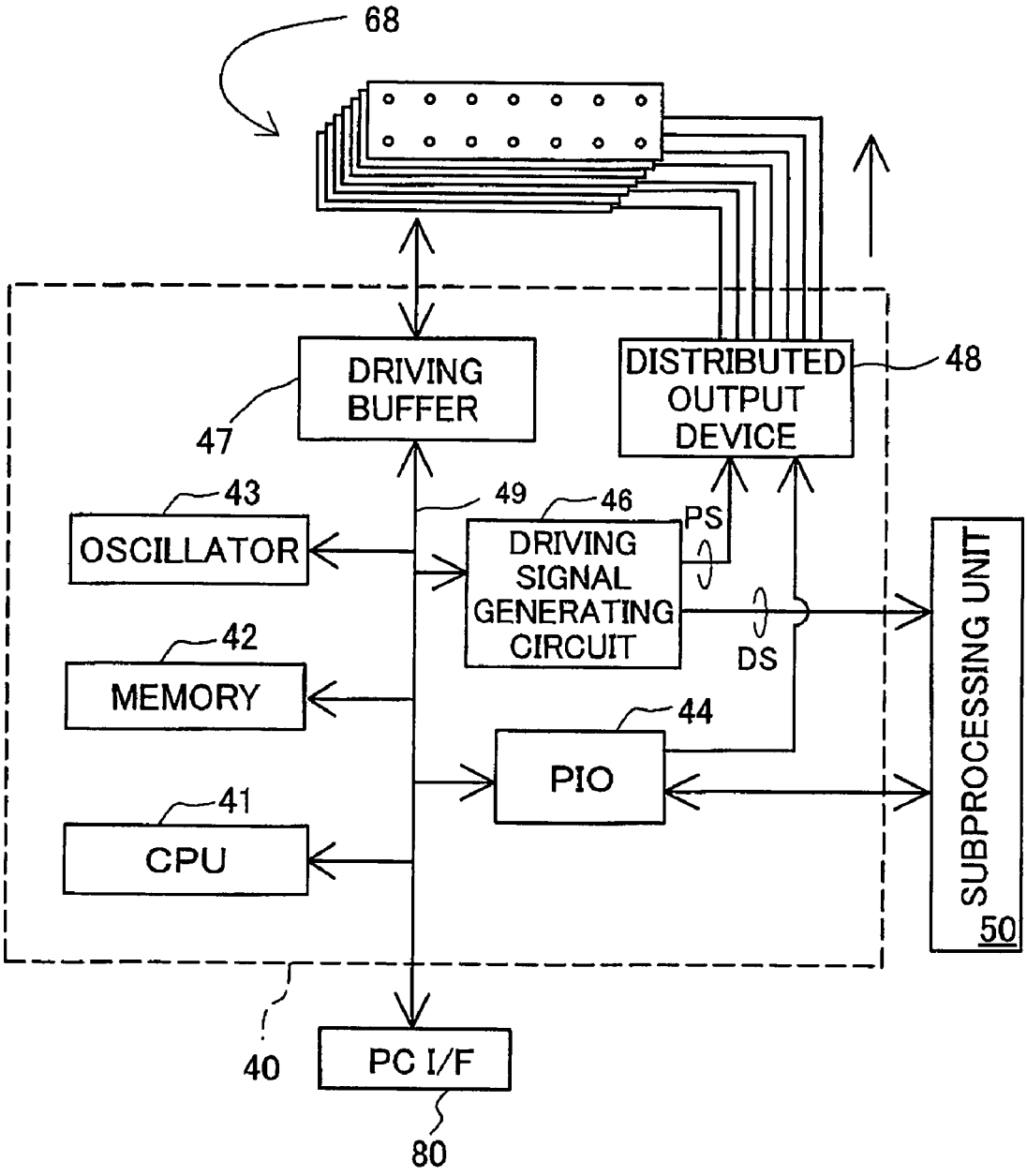
FIG. 2 illustrates an explanatory diagram of the electrical structure of the main controller in the first embodiment.
Figure 3:
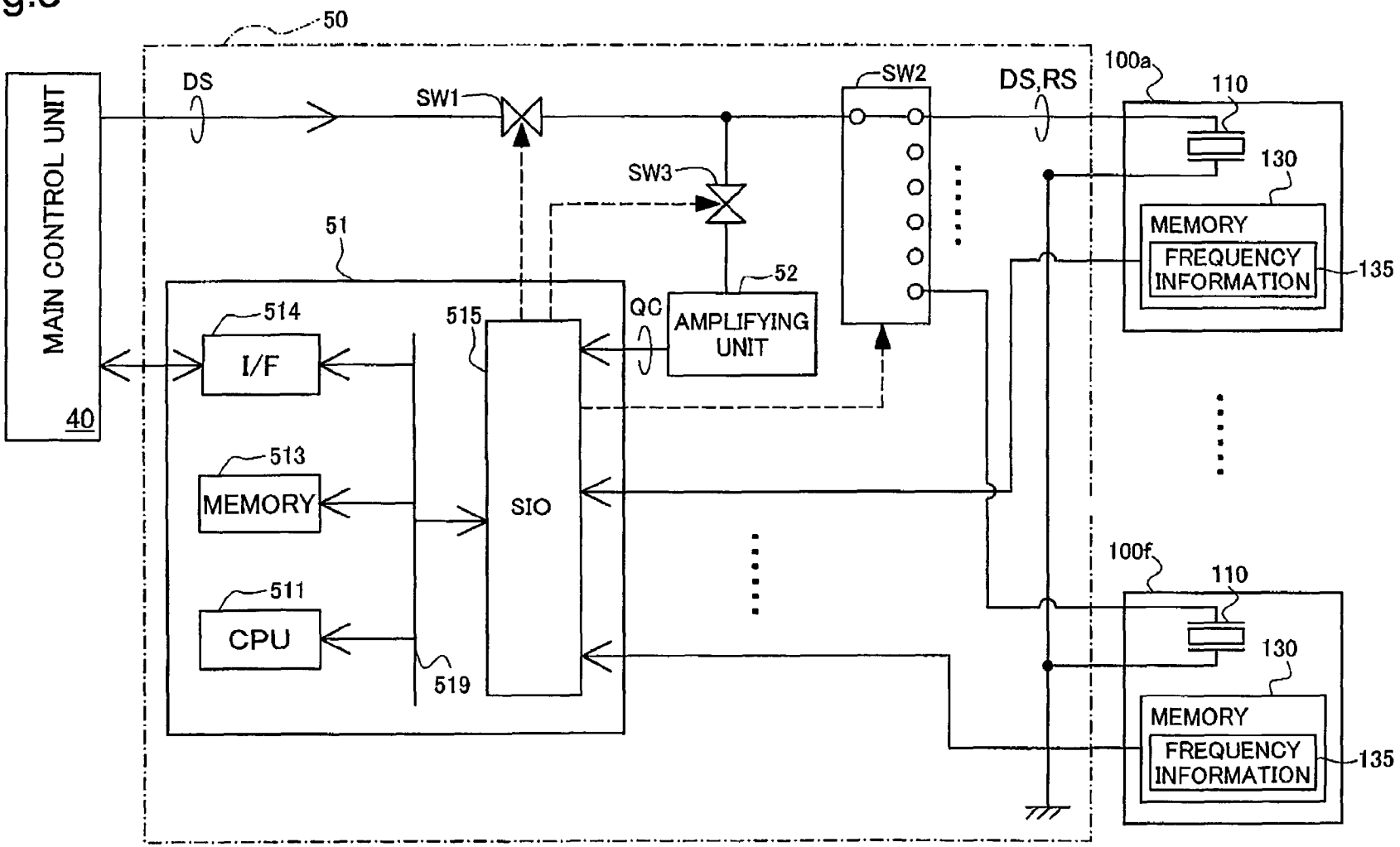
FIG. 3 illustrates an explanatory diagram of the electrical structure of a sub controller and a cartridge in the first of embodiment.

A2. Printer Circuit Structure:

FIG. 2 and FIG. 3 explain the circuit structure of the printer 20. FIG. 2 illustrates an explanatory diagram of the electrical structure of the main controller 40 in the first embodiment. FIG. 3 illustrates an explanatory diagram of the electrical structure of the sub controller 50 and the cartridge 100*a* in the first embodiment.

The main controller 40 comprises a CPU 41, a memory 43, and oscillator 44 for generating a clock signal, a peripheral device input/output unit (PIO) 45 for transferring signals with peripheral devices, a driving signal generating circuit 46, a driving buffer 47, and a distributed outputting device 48. These are connected through a bus 49. Moreover, the bus 49 is also connected to a connector 80, where the main controller 40 is connected through the bus 49 and the connector 80 to a computer 90. Connecting in this way enables the data transfer between the various constituent elements described above.

The driving buffer 47 is used as a buffer for providing dot ON/OFF signals to the printing head 69. The distributed outputting device 48 distributes the driving signals, supplied from the driving signal generating circuit 46, to the printing head 69 with a specific timing.

The driving signal generating circuit 46 generates a head driving signal PS that is supplied through the distributed outputting device 48 to the printing head 69, and two types of sensor driving signals DS1 and DS2 that are supplied to the piezoelectric elements 112 of the sensors 110 of the cartridges 100*a* through 100*f* through the sub controller 50. In the first embodiment, "driving signal" shall refer to a sensor driving signal. The driving signal generating circuit 46 supplies the generated driving signals DS1 and DS2 to the sensors 110 through the sub controller 50.

Specifically, the driving signal generating circuit 46 comprises a calculating unit, not shown, a digital/analog converter (D/A converter), and an amplifying circuit. The calculating unit uses the voltage waveform data to generate a digital signal indicating the waveform of the voltage to be generated. The D/A converter converts the generated digital data into an analog signal. The amplifier circuit amplifies the analog signal to generate a driving signal having a specific waveform.

The sub controller 50 is a circuit for implementing processes pertaining to the cartridges 100*a* through 100*f*, working together with the main controller 40. FIG. 3 selectively shows those processes pertaining to the cartridges 100*a* through 100*f* that are necessary in the process of determining the amount of ink. The sub controller 50, as shown in FIG. 3, comprises a calculating unit 51, 3 switches SW1 through SW3, and an amplifying unit 52.

The calculating unit 51 comprises a CPU 511, a memory 513, an interface 514, and an input/output unit (SIO) 515 for transferring signals with the constituent elements within the sub controller 50 and the cartridges 100*a* through 100*f*. Each of the constituent elements of the main controller 40, described above, is connected through a bus 519. The calculating unit 51 transfers signals with the main controller 40 through an interface 514. The calculating unit 51 controls the three switches SW1 through SW3 through the SIO 515. Moreover, the calculating unit 51 obtains frequency information 135, which is stored in a memory 130, from the memory 130 of the cartridges 100*a* through 100*f*, installed in the cartridge equipping unit 62.

The natural frequencies for when the printing material stored within the ink cartridge is stored to only less than a specific value at the time of the manufacturing of the ink cartridge are stored in the frequency information 135.

The first switch SW1 is a single-channel analog first switch. One of the terminals of the first switch SW1 is connected to the driving signal generating circuit 46 of the main controller 40, and the other terminal is connected to the second switch SW2 and the third switch SW3. This first switch SW1 is set to the ON state when a driving signal DS is supplied to the sensor 110, and set to the OFF state when a response signal RS is detected from the sensor 110.

The second switch SW2 is a 6-channel analog first switch. One of the terminals on one side of the second switch SW2 is connected to the first switch SW1 and to the third switch SW3, and the six terminals on the other side are each connected to one of the sensors 110 of each of the six cartridges one 100*a* through 100*f*. Note that the other electrode of each of the sensors 110 is connected to ground. By sequentially switching the second switch SW2, the six cartridges 100*a* through 100*f* are selected sequentially.

The third switch SW3 is a single-channel analog first switch. One of the terminals of the third switch SW3 is connected to the first switch SW1 and the second switch SW2, and the other terminal is connected to the amplifying unit 52. The third switch SW3 is set to the OFF state when a driving signal DS is supplied to the sensor 110, and is set to the ON state when a response signal RS is detected from a sensor 110.

The amplifying unit 52 includes an op amp, and functions as a comparator to compare the response signal RS and a reference voltage Vref to output a high signal when the voltage of the response signal is greater than the reference voltage Vref, and output a low signal when the voltage of the response signal RS is less than the reference voltage Vref. Consequently, the output signal QC from the amplifying unit 52 is a digital signal, comprising only the high signal and the low signal.

The CPU 41 counts the output signals QC that are outputted from the amplifying unit 52 to measure the frequency of the piezoelectric element 112, and determines the amount of ink that is stored in the ink cartridge based on this frequency. The process for determining the amount of ink will be described below.

Figure 4B:
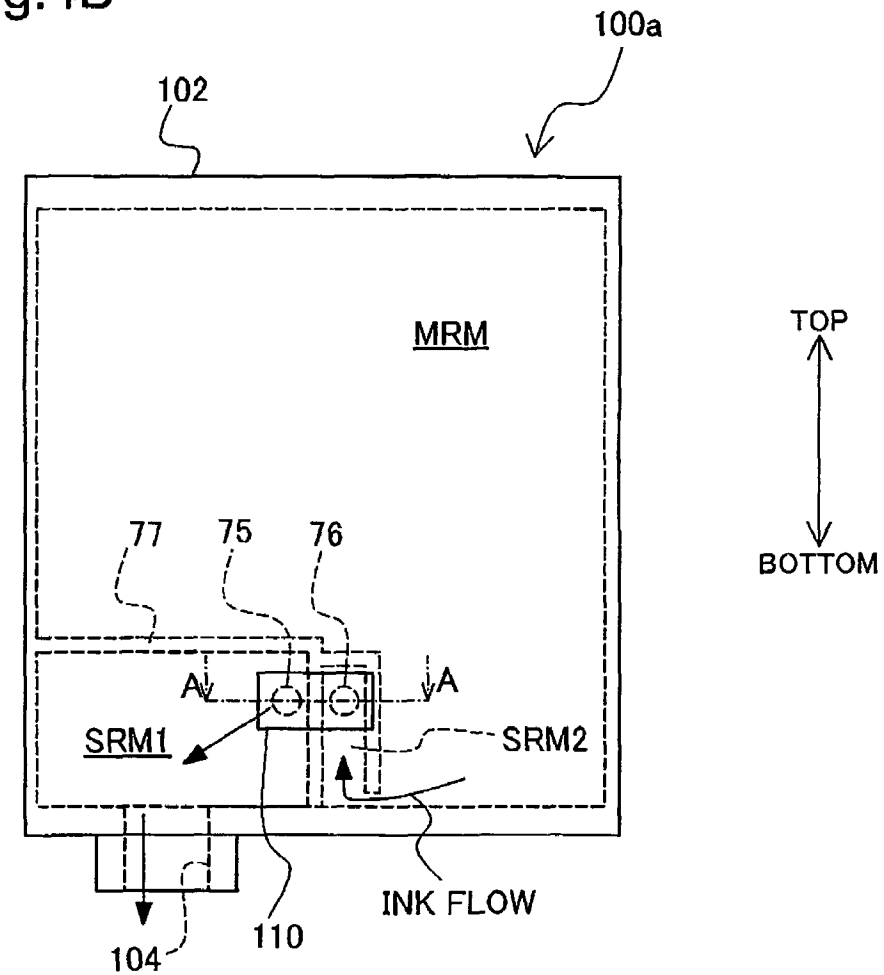
FIG. 4 illustrates an explanatory diagram of an ink cartridge structure in the first embodiment.
Figure 4A:
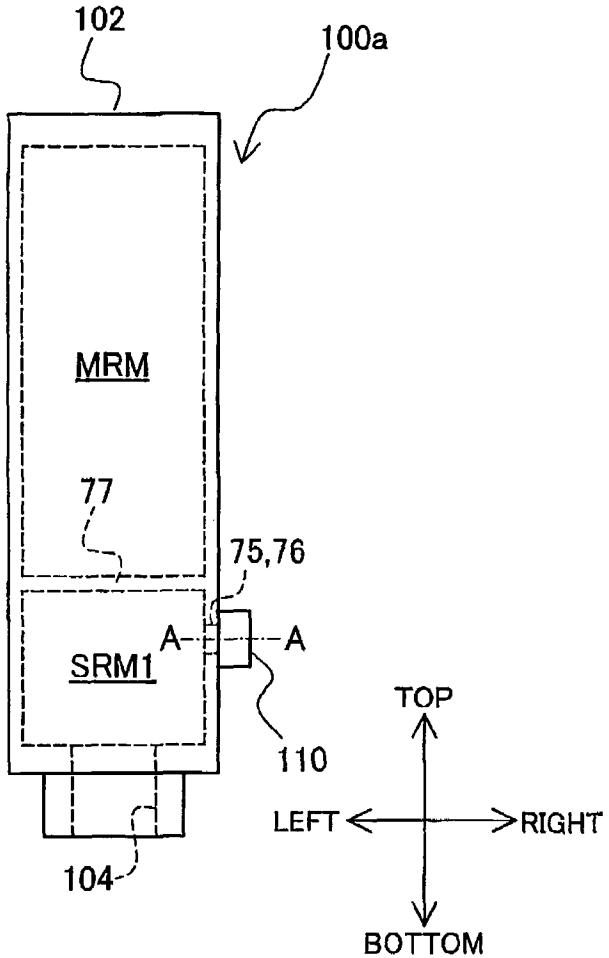
Figure 5A:
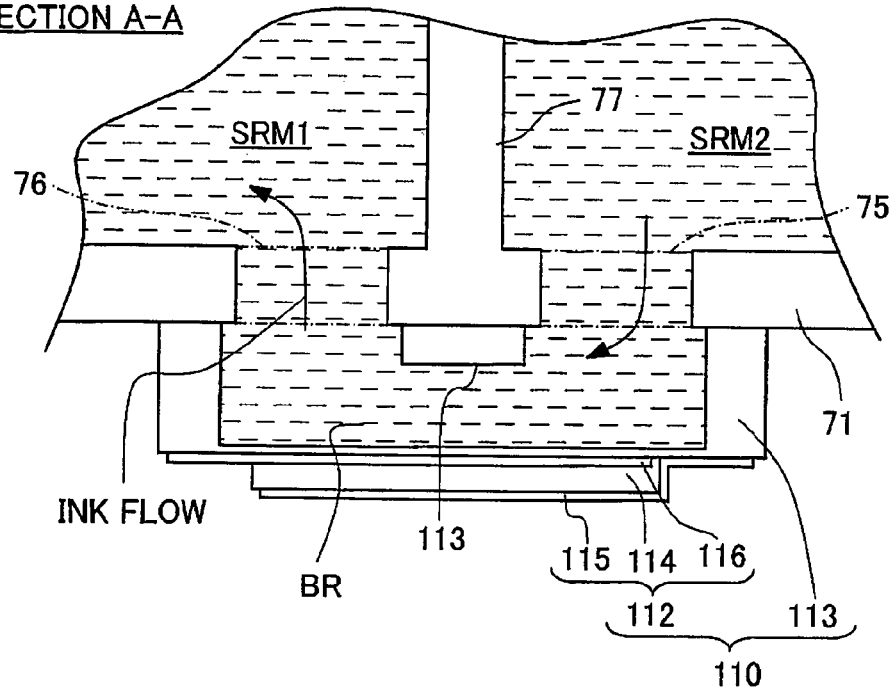
FIG. 5 shows a cross-sectional diagram of the parts around the sensor provided in the ink cartridge in the first embodiment.
Figure 5B:
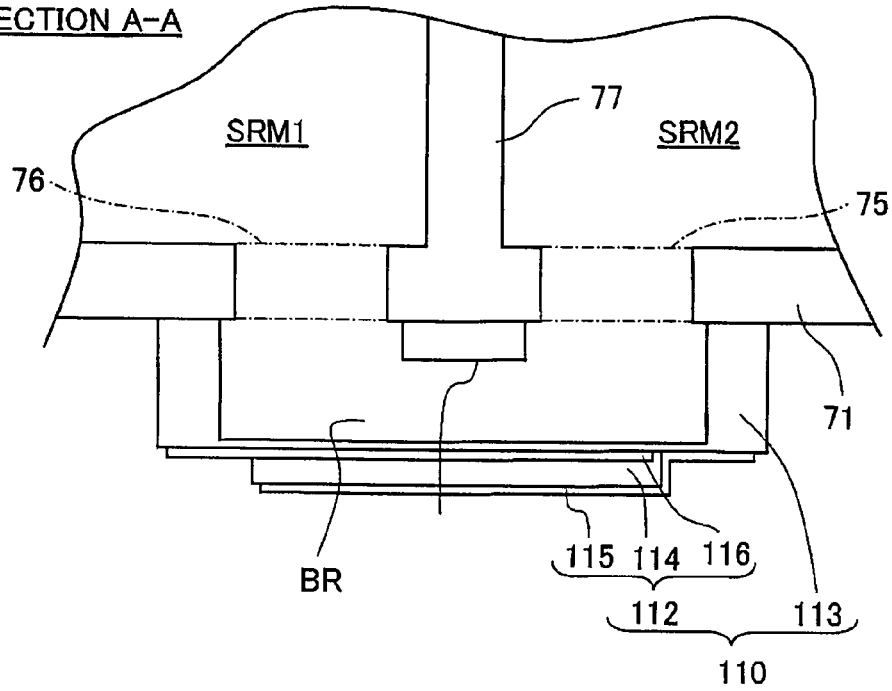

A3. Detailed Structure of the Ink Cartridge and Sensors:

FIG. 4 and FIG. 5 describes the detailed structure of the ink cartridge and sensors. FIG. 4 illustrates a front view (FIG. 4(*a*)) and a side view (FIG. 4(*b*)) of the structure of the ink cartridge. FIG. 5(*a*) and FIG. 5(*b*) shows cross-sectional diagrams of the parts around the sensors that are provided in the ink cartridge.

As is shown in FIG. 4(*a*) and FIG. 4(*b*), a case 102 of the cartridge 100*a* comprises a plurality of storage chambers for storing ink. The main storage chamber MRM occupies the majority of the volume of the storage chambers as a whole. A first secondary storage chamber SRM1 is connected, at the bottom surface thereof, to an ink supplying aperture 104. A second secondary storage chamber SRM2 is connected, at the vicinity of the bottom surface thereof, to the main storage chamber MRM.

FIG. 5(*a*) and FIG. 5(*b*) show cross-sectional diagrams of the parts around the sensors, cut along the section A-A in FIG. 4(*b*), when viewed from above. As FIG. 5(*a*) and FIG. 5(*b*) show, the sensor 110 comprises a piezoelectric element 112 and a sensor attachment 113. The piezoelectric element 112 comprises a piezoelectric part 114 and two electrodes 115 and 116, with the piezoelectric part 114 interposed therebetween, and is attached to the sensor attachment 113. The piezoelectric part 114 is a dielectric, formed from, for example, PZT (Pb (ZrxTi1-x) O3). A bridge flow duct BR is formed in essentially a block "U" shape within the sensor attachment 113. The sensor attachment 113 is formed in the shape of a thin film between the bridge flow duct BR and the piezoelectric element 112. By structuring in this way, the parts around the piezoelectric element 112, including the bridge flow duct BR vibrates with the piezoelectric element 112.

The ink that is stored in the cartridge 100*a* flows as shown by the solid arrows in FIGS. 4(*a*) and (*b*) and in FIGS. 5(*a*) and (*b*). Specifically, the ink that is stored in the main storage chamber MRM flows into the second secondary storage chamber SRM2 from the vicinity of the bottom surface thereof. The ink that has flowed into the second secondary storage chamber SRM2 passes through a second side surface hole 76, the bridge flow duct BR of the sensor attachment 113, and a first side surface hole 75 to flow into the first secondary storage chamber SRM 1. The ink that flows into the first secondary storage chamber SRM1 passes through an ink supplying aperture 104 to be supplied to the printing head unit 60.

FIG. 5(*a*) illustrates the state wherein there is more than a specific amount of ink in the cartridge 100*a* (termed in the first embodiment, the "ink full state"). The ink full state, as shown in FIG. 5(*a*) is a state wherein the bridge flow duct BR that is formed within the sensor attachment 113, which is a part of the sensor 110, is filled with ink. In other words, the ink full state is the state wherein there is ink in the position wherein the sensor 110 is disposed within the cartridge 100*a* (that is, there is ink at the ink detecting position), where the ink is in contact with the part that is shaped as a thin film (the ink detecting region) that is interposed between the bridge flow duct BR and the piezoelectric element 112.

On the other hand, FIG. 5(*b*) illustrates the state wherein there is only less than the specific amount of ink within the cartridge 100*a* (termed, in the first embodiment, the "ink end state," below). The ink end state is a state wherein ink does not fill the bridge flow duct BR. In other words, the ink end state is a state wherein there is no ink at the ink detecting position, and ink does not contact in the ink detecting region.

A4. Operation of the Piezoelectric Element:

The operation of the piezoelectric element will be described. When a driving signal is provided from the printer 20 to the piezoelectric element 112 that is equipped in the cartridge 100*a* to apply a voltage thereto, the piezoelectric element 112 expands and contracts. When the provision of the driving signal to the piezoelectric element 112 is stopped, to stop the application of the voltage, the piezoelectric element 112 vibrates depending on the expansion and contraction that occurred prior to the cessation of the provision of the driving signal (that is, has residual vibration).

A response signal is outputted from the piezoelectric element 112 in accordance with the residual vibration. The frequency of the response signal is a value that is the same as the natural frequency of the residual vibration of the piezoelectric element 112. The natural frequency of the residual vibration of the piezoelectric element 112 changes greatly depending on whether ink is in contact with the ink detecting region. That is, the piezoelectric element 112 has different natural frequencies in the ink full state and the ink end state. Specifically, the natural frequency H1 of the piezoelectric element 112 in the ink full state is low, and the natural frequency H2 of the piezoelectric element 112 in the ink end state is high. Consequently, the printer 20 is able to measure the frequency of the response signal that accompanies the residual vibration of the piezoelectric element 112 (hereinafter termed the "vibration frequency" in the first embodiment) to determine whether the amount of remaining ink is less than the specific amount by determining whether the measured vibration frequency is near natural frequency H1 or H2. Below, in the first embodiment, the frequency of the response signal accompanying the residual vibration of the piezoelectric element 112 shall be termed the "vibration frequency."

A5. The Driving Signals:

The driving signals for improving the accuracy of detection of the vibration frequencies will be described here. As described above, the printer 20 provides driving signals to the piezoelectric elements provided in the cartridge, and measures the frequencies of the response signals that are outputted by the piezoelectric elements to determine the amounts of ink stored in the cartridge. Because of this, it is desirable, from the perspective of increasing the accuracy of detection of the vibration frequencies in the response signals, to improve the amplitudes of the response signals. Consequently, it is desirable to match the frequency of the driving signal with the natural frequency of the piezoelectric element 112 in order to improve the accuracy of detection of the vibration frequency in the response signal. This is because the piezoelectric element will resonate and output a response signal with a large amplitude when a driving signal having the same frequency as the natural frequency of the piezoelectric element is provided to the piezoelectric element.

a Conventionally, the printer 20 provides, to the sensor 110, a driving signal at a frequency that is the same as the natural frequency H2 in the ink end state, to determine whether the amount of ink in the cartridge is less than the specific amount, and then provides, to the sensor 110, a driving signal with the same frequency as the natural frequency H1 in the ink full state to determine if the amount of ink within the cartridge is more than a specific amount, where two separate decision processes have been implemented. In such a case there has been a problem in that the time required for making the decision was long.

Given this, the structure of the cartridge is adjusted so that there will be the following relationship (Equation 1) between the natural frequency H1 and the natural frequency H2:

$$H2=(2k+1)\times H1 \text{ (where k is an integer no less than 1)} \quad \text{(Equation 1)}$$

Note that in the cartridge manufacturing process, the shape of the bridge flow duct BR in the cartridge, or the stiffness of the sensor attachment 113, for example, are adjusted during the cartridge manufacturing process.

The structure such as described above is able to stimulate effectively the amplitude of the residual vibration in the ink full state and the ink end state using one type of driving signal. Therefore it is possible to determine the amount of ink in a single decision process while maintaining detection accuracy.

Figure 6:
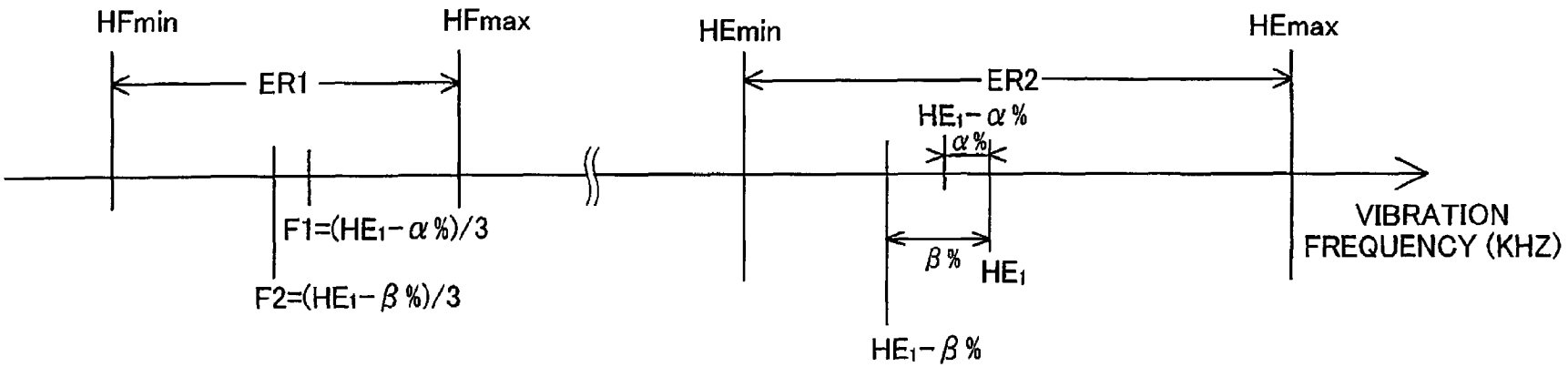
FIG. 6 illustrates an explanatory diagram of the tolerance range of the natural frequencies in the cartridge in the first embodiment.

However, because there is manufacturing tolerance error in the cartridge sensors in the manufacturing process, it is difficult to make the natural frequencies of all manufactured cartridges be the same. Consequently, typically there is a discrepancy between the natural frequency HF and the natural frequency HE of the cartridges that are actually manufactured from the respective targeted natural frequencies H1 and H2 (where in the below, in the first embodiment, the natural frequency H1 and the natural frequency H2 shall be termed the target natural frequency H1 and the target natural frequency H2). This discrepancy is explained using FIG. 6. FIG. 6 illustrates an explanatory diagram of the tolerance range of the natural frequencies for cartridges in the first embodiment. The tolerance range ER1 shown in FIG. 6 shows the tolerance range for the natural frequencies of the piezoelectric elements in the ink full state, and the tolerance range ER2 shows the tolerance range of the natural frequency HE of the piezoelectric element in the ink end state.

As FIG. 6 shows, the tolerance range ER1 of the natural frequency HF in the ink full state is "HFmin (kHz)–HFmax (kHz)." On the other hand, as FIG. 6 shows, the tolerance range ER2 of the natural frequency HE in the ink end state is "HEmin (kHz) to HEmax (kHz)." Note that the vibration frequencies included in the tolerance range ER1 may be lower than the vibration frequencies included in the tolerance range ER2.

The natural frequency HF and the natural frequency HE each have their own manufacturing tolerances; however, between the natural frequency HF and the natural frequency HE there is the relationship that HE is approximately (2k+1)×HF. Consequently, in the first embodiment the first frequency F1 is calculated through the application of Equation 2. In the first embodiment, the natural frequency in the ink full state for the cartridge to be processed is defined as $HF_1$, and the natural frequency in the ink end state is defined as the natural frequency $HE_1$. Note that the natural frequency $HE_1$ of the sensor 110 in the ink end state is able to be calculated in manufacturing testing.

The driving signal frequency $F=1/(2k+1)\times$ natural frequency $HE_1$ (Equation 2)

When supplying in the driving signal of the driving signal frequency F to the piezoelectric elements, if the natural frequency $HE_1$ of the piezoelectric element for a cartridge that is the subject of the process, in the ink end state, is in the range shown below (Equation 3), then this is seen as having sufficient accuracy. In the first embodiment, the range indicated by Equation 3, below, is termed the detectable range DR. Note that k=1 in the present embodiment.

(Driving signal frequency F×3)$-\gamma_1$% ? natural frequency $HE_1$? (driving signal frequency F×3)+$\gamma_1$% (Equation 3)

In the first embodiment, $\gamma_1=8$. In other words, if the natural frequency $HE_1$ is included in "(Driving signal frequency F×3)78%," then the amplitude of the response signal in the ink end state will be stimulated effectively.

Normally it is possible to determine accurately the amount of ink in the ink full state/ink end state using a single driving signal through the use of the driving signal frequency F that is calculated in Equation 2, calculated as described above.

However, there are times wherein the accuracy of the determination of the amount of ink is reduced when, for any of a variety of reasons, the natural frequency of the sensor in the cartridge changes. For example, sometimes the natural frequency of a sensor in the ink end state is lower than the natural frequency $HE_1$, calculated in manufacturing testing, because of dried ink adhering to the wall surface on the sensor 110 side of the bridge duct BR when actually the cartridge is in a state wherein there is no ink. Moreover, if there is damage to an ink cartridge through, for example, a physical shock, the natural frequencies of the sensors in the ink cartridge might be different from the natural frequencies HF and HE from the time of manufacturing the sensors.

When the natural frequencies of the sensors in the ink cartridge change from the natural frequencies from the time of manufacturing, then the residual vibrations of the sensors may not be stimulated effectively by the driving signal having the driving signal frequency determined based on the natural frequencies at the time of sensor manufacturing, so that it becomes impossible to obtain an adequate amplitude in the response signal. When it is not possible to obtain an adequate amplitude, it becomes impossible to measure accurately the vibration frequency because the voltage of the response signal does not rise above the reference voltage Vref.

Typically the natural frequency is reduced by material adhering to the ink sensor or by damage to the cartridge. Given this, as shown in Equation 4, a method is able to be considered wherein the accuracy of detection of the vibration frequency is improved by having the frequency of the driving signal (where, in the present embodiment, below, this is termed the "first frequency F1") be a value that is 1/(2k+1) times a vibration frequency that is lower, by a constant ratio ($\alpha$%) than the natural frequency $HE_1$ of the ink end state calculated at the time of manufacturing, as shown in Equation 4. In the present embodiment, the value of $\alpha$ is preferably the same as for $\gamma_1$, or slightly lower than $\gamma_1$. This is because if the value were higher than $\gamma_1$, then the response signal would not be stimulated effectively if the natural frequency doesn't change. In the first embodiment, $\alpha=7$. $\alpha$ is a value that is determined based on the results of manufacturing testing, and is not limited to $\alpha=7$.

First frequency $F1=(HE_1-\alpha\%)/3$ (Equation 4)

However, because there will be differences in the amounts of change in the natural frequency $HE_1$ due to the amount of ink adhering to the sensor when in the ink end state, and due to scratches. Therefore there has been a large amount of change in the natural frequency HE1. As a result, it would not be possible to obtain an adequately large amplitude in the response signal, making it impossible to measure with good accuracy the vibration frequency, in the driving signal DS1 that uses as the driving signal frequency a value that is 1/(2k+1 times a vibration frequency that is lower, by a constant ratio ($\alpha$%) then the natural frequency $HE_1$ when, after the change, the natural frequency $HE_1$ is lower than (first frequency F1×3)$-\gamma_1$.

Consequently, in the present embodiment, the amount of ink within the ink cartridge is determined using a first vibration frequency VF1 that is measured after providing a driving signal DS1 to the piezoelectric element, and a second vibration frequency VF2 that is measured after providing a driving signal DS2 to the piezoelectric element, based on two different driving signals, the driving signal DS1 that has the first frequency F1, and a driving signal DS2 having a second frequency F2, which is a frequency having a value that is 1/(2k+1) times a frequency that is lower, by a fixed ratio ($\beta$%, where $\beta>\alpha$) from the natural frequency $HE_1$, as shown in Equation 5. This is described in detail below. Note that in the present embodiment, $\beta=15$.

Second frequency $F2=(HE_1-\beta\%)/3$ (Equation 5)

When the driving signal having the first frequency F1 is provided to the piezoelectric element, the amplitude of the response signal will be stimulated effectively if the natural frequency $HF_1$ after the change in the piezoelectric element of the cartridge that is the subject of the process, in the ink full state, is within the range indicated by Equation 6 below. Moreover, when providing a driving signal with the second frequency F2 to the piezoelectric element, the amplitude of the response signal will be stimulated effectively if the natural frequency $HF_1$, after the change in the piezoelectric element in the cartridge to be processed, when in an ink full state, is in the range of Equation 7, as shown below. In the present embodiment, $\gamma_2=25$.

(First frequency F1)$-\gamma_2$% ? natural frequency $HF_1$? (first frequency F1)+$\gamma_2$% (Equation 6)

(Second frequency F2)$-\gamma_2$% ? natural frequency HF1? (second frequency F2)+$\gamma_2$% (Equation 7)

Note that the values for $\gamma_1$, and $\gamma_2$, and $\alpha$ are values that are determined based on manufacturing testing, so there are no limitations that $\gamma_1=8$, $\gamma_2=25$, $\alpha=7$, and $\beta=15$.

A6. Relationship between the Change in the Natural Frequency and the Amplitude of the Response Signal:

FIG. 7(*a*) and FIG. 7(*b*) explain the relationship between the change in the natural frequency of a sensor and the amplitude of the response signal. FIG. 7(*a*) shows a correlation table 500 for explaining the relationship between the natural frequency of the sensor and the amplitude of the response signal when a driving signal DS1 with the first frequency F1 is provided. FIG. 7(*b*) shows correlation table 510 for explaining the relationship between the natural frequency of the sensor and the amplitude of the response signal when a driving signal DS2 with the second frequency F2 is provided.

The correlation table 500 shows the status of the cartridge and the amplitude of the response signal when the driving signal DS1, having the first frequency F1, is provided to the piezoelectric element. Similar to the correlation table 500, the correlation table 510 shows the status of the cartridge and the amplitude of the response signal when the driving signal DS2, having the second frequency F2, is provided to the piezoelectric element. Both correlation tables 500 and 510 include, in the cartridge statuses, the "Amount of change in the natural frequency," which indicates the amount of change in the natural frequency of a sensor provided in the cartridge, and "Amount of ink," which indicates either a cartridge ink full state or ink end state. The "Amplitude of response signal" in the correlation tables 500 and 510 indicates whether the amplitude in the response signal is stimulated to be an amplitude that is adequate for measuring the vibration frequency. For example, as is shown in the correlation table 500, the "Adequate" indicates that the amplitude of the vibration frequency is stimulated to an amplitude that is adequate for measuring the vibration frequency, and "Inadequate" indicates that the amplitude of the vibration frequency is not stimulated to an amplitude that is adequate for measuring the vibration frequency.

As shown in the correlation table 500, if, when the driving signal DS1 is provided to the piezoelectric element, the amount of change in the natural frequency is large so that the natural frequency HE after the change is not within the first frequency F1 8%, then the amplitude of the response signal will not be adequately simulated, so that the vibration frequency may be measured incorrectly. On the other hand, if the amount of change in the natural frequency HE is small so that the natural frequency HE after the change is within the range of the first frequency F1 78%, then, as shown by the correlation table 500, the amplitude of the response signal will be adequately stimulated, in both the ink full state and the ink end state, so that the vibration frequency will be measured accurately.

Moreover, as shown in the correlation table 510, if, when the driving signal DS2 is provided to the piezoelectric element, the amount of change in the natural frequency is large so that the natural frequency HE after the change is not within the second frequency F2 78%, then the amplitude of the response signal will not be adequately simulated, so that the vibration frequency may be measured incorrectly. On the other hand, if the amount of change in the natural frequency HE is small so that the natural frequency HE after the change is within the range of the second frequency F2 78%, then, as shown by the correlation table 510, the amplitude of the response signal will be adequately stimulated, in both the ink full state and the ink end state, so that the vibration frequency will be measured accurately.

Note that in the present embodiment, the value of $\alpha$ is set so that the amplitude of the response signal will be adequately stimulated by the provision, to the piezoelectric element, of the driving signal DS1 having the first frequency F1 when the natural frequency HE doesn't change.

Figure 8:
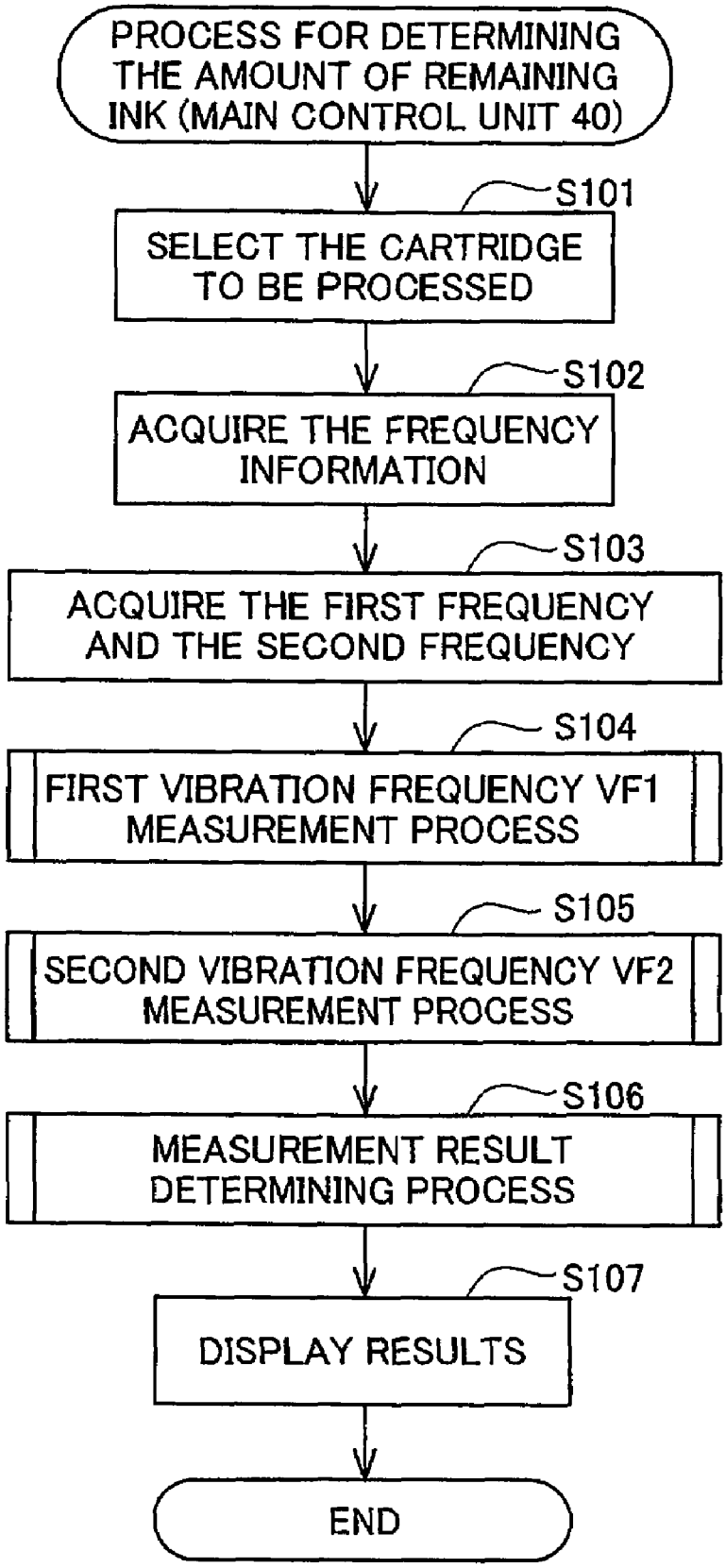
FIG. 8 shows a flowchart for explaining the ink amount determination process in the first embodiment.
Figure 9:
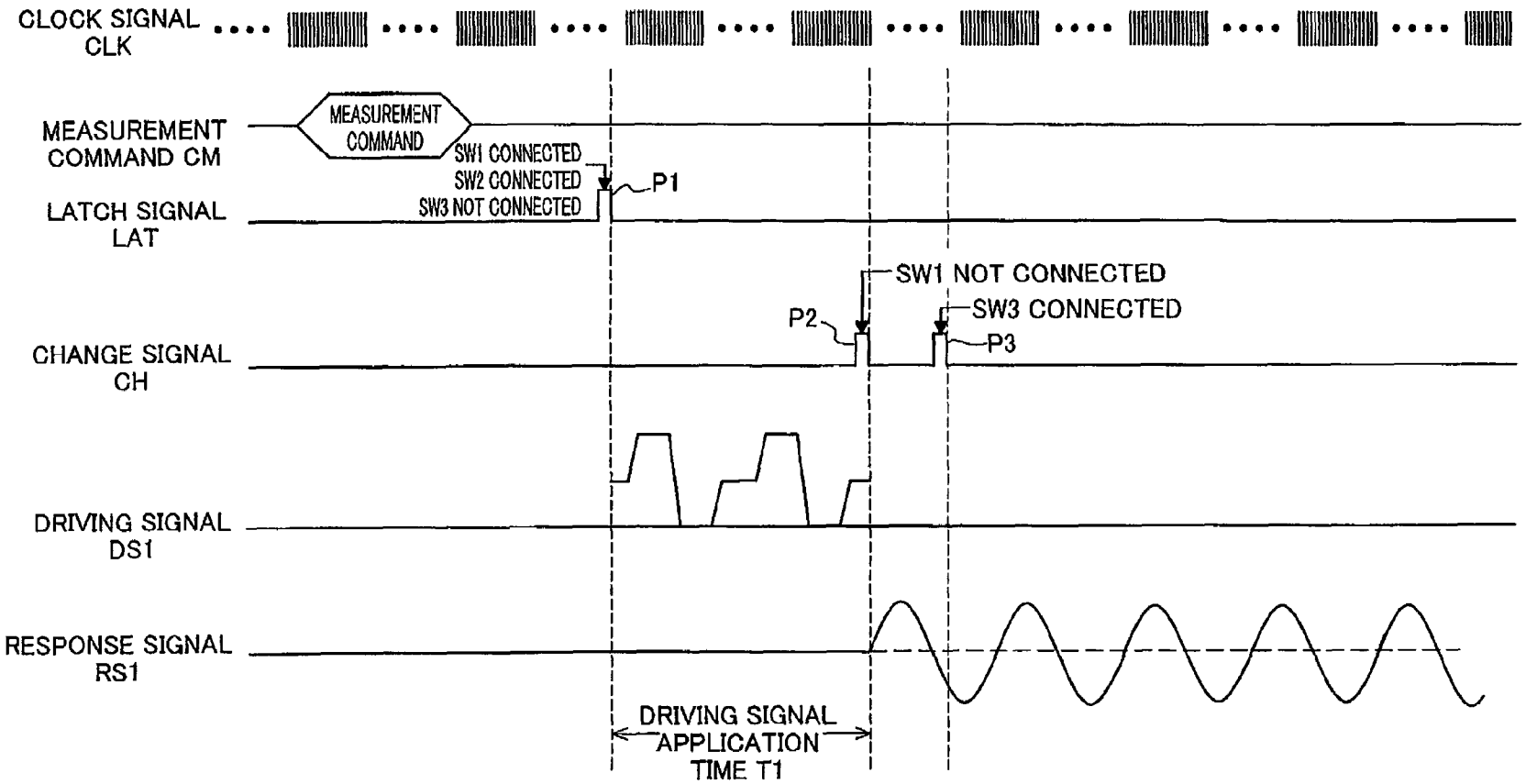
FIG. 9 shows a timing chart of the process for measuring the frequencies in the first of embodiment.
Figures 10, 11:
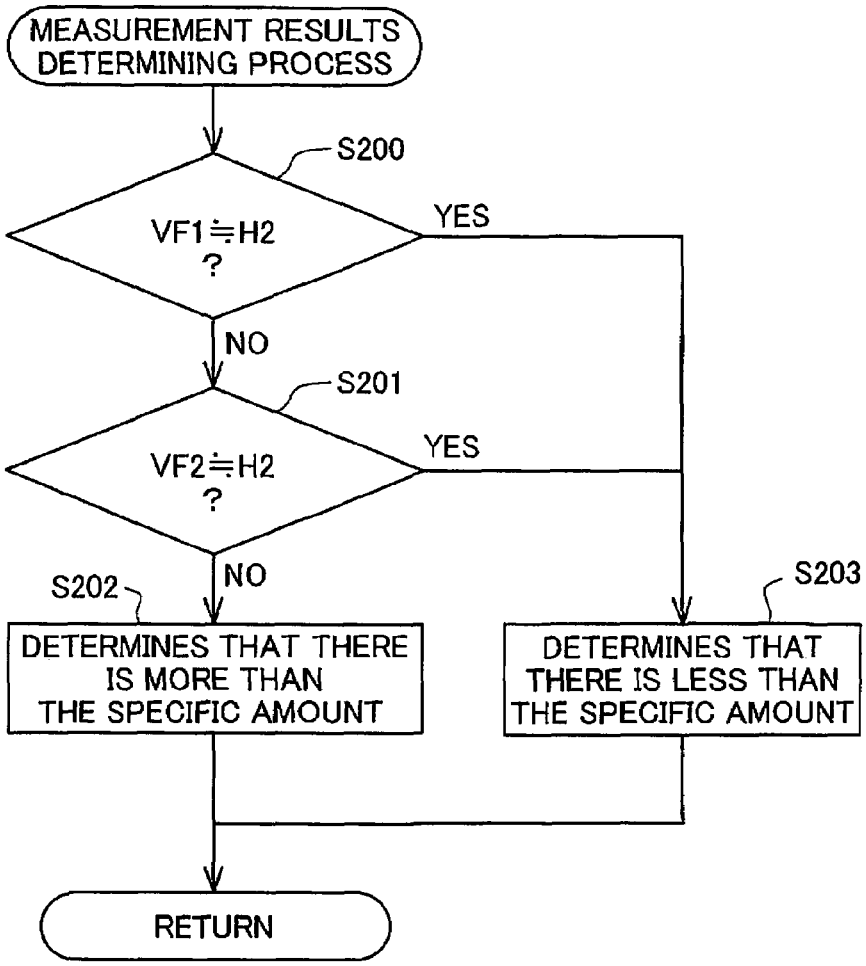
FIG. 10 shows a flowchart of the detail of the measurement result determining process in the first embodiment.
FIG. 11 illustrates an explanatory diagram of an ink amount determining table in the first embodiment.

A7. Process for Determining the Amount of Ink:

FIG. 8 through FIG. 11 show the for ink amount determination process, wherein the process is implemented through cooperation of the main controller 40 and the sub controller 50 of the printer 20. FIG. 8 is a flowchart for describing the process for determining the amount of ink in the first embodiment. FIG. 9 shows a timing chart of the frequency measuring process in the first embodiment. FIG. 10 shows a flowchart for describing in detail the process for determining the measurement results in the first embodiment. FIG. 11 illustrates an explanatory diagram of a decision table for the amount of ink in the first embodiment.

The ink amount determination process that determines, for each cartridge, whether the amount of ink stored in the cartridge is greater than a specific amount of ink, or less than the specific amount of ink. The process for determining the amount of ink is implemented when the power supply of the printer 20 is first turned ON.

When the process for determining the amount of ink is started, the CPU 41 of the main controller 40 selects a cartridge, from the six cartridges 100*a* through 100*f*, to be the cartridge that is subject to the processing in the process for determining the amount of ink (Step S101).

The main controller 40 acquires, from the memory 130 that is provided in the cartridge to be processed, frequency information 135 relating to the natural frequency of the piezoelectric element 112 (Step S102). Specifically, the main controller 40 sends, to the calculating unit 51 of the sub controller 50, a command to cause the sub controller 50 to acquire the frequency information 135 that is stored in the memory 130 of the cartridge to be processed. The CPU 511 of the calculating unit 51 follows the instruction of the command to acquire the frequency information 135, and sends the frequency information 135 to the sub controller 50.

The main controller 40 acquires the first frequency F1 and the second frequency F2 based on the frequency information 135 (Step S103).

The main controller 40 uses the driving signal DS1, having the first frequency F1, to implement the measurement process of the first vibration frequency VF1 (Step S104). The timing chart shown in FIG. 10 shows the process for measuring the first vibration frequency VF1. The clock signal CLK, the measurement command CM, the latch signal LAT, and the change signal CH shown in FIG. 10 are signals that are sent from the main controller 40 to the calculating unit 51 in the sub controller 50 in the process for measuring the frequency. The switch control signal CS is a signal that is outputted from the switch controller 516. The measurement command CM includes instruction of the implementation of the process for measuring the frequency, and information specifying the cartridge to be processed. The driving signal DS, as described above, is a signal that is outputted from the driving signal generating circuit 46 of the main controller 40. The response signal RS is the signal that is generated in accordance with the residual vibration of the piezoelectric element after the driving signal DS has been provided. The output signal QC is a signal that is outputted from the amplifying unit 52 to the calculating unit 51.

The calculating unit 51 of the sub controller 50 controls the second switch SW2 to cause a state wherein the piezoelectric element 112 of the cartridge to be processed is connected to the sub controller 50, following the measurement command CM that has already been received, with the timing with which the latch pulse P1, which is a latch signal, is received. Additionally, the calculating unit 51 connects the first switch SW1 with the timing with which the latch pulse P1 is received. Doing this causes the driving signal generating circuit 46 to be connected electrically to the cartridge 100*a* to be processed, so the driving signal DS1 is applied to the piezoelectric element of the cartridge to be processed. Moreover, the calculating unit 51 causes the third switch SW3 to be disconnected with the timing with which the latch pulse P1 is received. This causes the amplifying unit 52 to be electrically cut off from the driving signal generating circuit 46 and the piezoelectric element 112, so that the driving signal DS1 is not applied to the amplifying unit 52.

With the timing with which the application of the driving voltage is stopped, the main controller 40 generates a change pulse P2. The calculating unit 51 of the sub controller 50 disconnects the first switch SW1 with the timing with which the change pulse P2 is received. The time from the latch pulse P1 to the change pulse P2 is referred to as the driving voltage application time T1.

After the driving voltage application time T1 has been completed, then the piezoelectric element 112, wherein a vibration has been stimulated by the driving signal, outputs a response signal RS depending on the deformation by the vibration. After generating the change pulse P2, the main controller 40 generates the change pulse P3. The calculating unit 51 of the sub controller 50 connects the third switch SW3 with the timing with which the change pulse P3 is received. The result is that the response signal RS from the piezoelectric element 112 is inputted into the amplifying unit 52.

The amplifying unit 52 functions as a comparator, as described above, and outputs to the calculate device 51 an output signal QC that is a digital signal depending on the waveform of the response signal RS. The calculating unit 51 measures the first vibration frequency VF1 of the response signal RS based on the acquired output signal QC and sends the results to the main controller 40.

The main control unit 40 uses the driving signals DS2 having the second frequency F2 after measuring the first vibration frequency VF1 to implement the measuring process of the second vibration frequency VF2 (Step S105). The measuring process of the second vibration frequency VF2 is implemented, except the driving signal provided to the piezoelectric element is DS2, as same as the measuring process of the first vibration frequency VF1 described above.

The main controller 40 uses the measured first vibration frequency VF1 and second vibration frequency VF2 to implement the process for determining the amount of ink (Step S106). Specifically, in the present embodiment, the main controller 40 determines the amount of ink by the commendation of target natural frequencies H1 and H2 that are nearest to the first vibration frequency VF1 and the second vibration frequency VF2. The determination of the amount of ink will be explained referencing FIG. 10 and FIG. 11. The Ink Amount Determining Table 600 shown in FIG. 11 shows the combinations of the natural frequencies H1 and H2 of the sensor that are nearest the first vibration frequency VF1 and [the second vibration frequency] VF2, and shows the ink amount determining results corresponding to each combination. Along with describing the process flow using the flowchart of FIG. 10, the explanation will also reference the Ink Amount Determining Table 600 in FIG. 11 as appropriate.

The main controller 40 determines whether the first vibration frequency VF1 is close to the target natural frequencies H2 (Step S200).

If the first vibration frequency VF1 is near to the target natural frequency H2, or in other words, if the combination in the Ink Amount Determining Table 600 is the pattern of number "3" and "4" (Step S200: Yes), then the main controller 40 determines that the ink stored in the cartridge being processed is less than the specific amount (Step S203).

If the first vibration frequency VF1 is not near the target natural frequency H2, or in other words, if near to the target natural frequency H1 (Step S200: No) then the main controller 40 determines whether the second vibration frequency VF2 is near the target natural frequency H2 (Step S201).

If the second vibration frequency VF2 is near the target natural frequency H2, or in other words, if the pattern in the Ink Amount Determining Table 600 is number "2" (Step S201: Yes), then the main controller 40 determines that the amount of ink stored in the cartridge being processed is less than the specific amount (Step S203).

If the amount of ink stored in the cartridge is less than the specific amount, or in other words, if in the ink end state, then, as described above, if the natural frequency HE of the sensor is in the range of "(the first frequency F1×3)±8%," then the amplitude of the response signal is stimulated effectively. In the first embodiment, if the natural frequency HE of the sensor has changed greatly so that the natural frequency HE of the sensor is outside of the range of "(the first frequency F1×3)±8%," in the ink end state, then the amplitude of the response signal might not be stimulated effectively. Similarly, if the natural frequency HE of the sensor does not change or changes only slightly, then the natural frequency HE of the sensor at the ink end state will not be in the range of "(the second frequency F2×3±8%," and the amplitude of the response signal may not be stimulated effectively. If the amplitude of the response signal is not stimulated effectively, then the vibration frequency will be measured incorrectly.

If the first vibration frequency VF1 or the second vibration frequency VF2 is measured incorrectly, then, as shown in combination numbers "2" and "3" in the Ink Amount Determining Table 600, the target natural frequencies to which the vibration frequencies are near will be mutually different. As described above, that wherein the vibration frequency is measured incorrectly is the case of the ink end state, and thus if the first vibration frequency VF1 and/or the second vibration frequency VF2 is near to the target natural frequency H2, then the main controller 40 in the present embodiment determines that the amount of ink that is stored in the cartridge being processed is less than the specific amount.

If the second vibration frequency VF2 is not near the target natural frequency H2, or in other words, in the case of the pattern number "1" in the Ink Amount Determining Table 600 (Step S201: No), then the main controller 40 determines that ink of more than the specific amount is stored in the cartridge being processed (Step S202).

If more than the specific amount of ink is stored in the cartridge, or in other words, if in the ink full state, then, as described above, if the natural frequency HF the sensor is in the range of "the first frequency F1±25%," then the amplitude of the response signal will be stimulated effectively. In the first embodiment, the range of "the first frequency F1±25%" is adequately large relative to the range over which the natural frequency HF of the sensor various. Because of this, regardless of whether there is a change in the natural frequency HF of the sensor, and regardless of the magnitude of the change, the natural frequency HF of the sensor in the ink full state will be in the range of "the first frequency F1±25%," and the amplitude of the response signal will be stimulated effectively, so the vibration frequency will not be measured incorrectly.

As described above, by determining the amount of ink based on the combination of target natural frequencies H1 and H2 to which the first vibration frequency VF1 and the second vibration frequency VF2 are near, it is possible to determine the amount of ink with excellent precision even when there have been changes to the natural frequencies of the sensors.

After the amount of ink has been determined, the main controller 40 displays the results of determining the amount of ink onto the display of the computer 90 (Step S107), and the process is terminated.

The printer as set forth in the embodiment described above makes it possible to determine with excellent accuracy the amount of ink stored in the ink cartridge, even when there has been a change in the natural frequency of the piezoelectric element of the ink cartridge due to, for example, damage to the ink cartridge. Moreover, because the amount of change in the natural frequencies will be different depending on the amount of ink that is adhered to the sensor and depending on the degree of damage to the sensor, the printer in the first embodiment makes it possible to determine the amount of ink based on two different vibration frequencies that are measured using two different driving signals having different frequencies, thus making it possible to improve the accuracy when determining the amount of ink. Moreover, in the printer in the first embodiment, if one of the two different vibration frequencies measured using the two different driving signals is near to the natural frequency in the ink end state, then it is determined that the amount of ink stored in the ink cartridge is less than the specific amount, making it possible to determine the amount of ink easily, and making it possible to reduce the processing time.

B. Second Embodiment

The first embodiment, described above, included the natural frequency for when there is no ink from the time that the ink cartridge was manufactured. In the second embodiment, the following form is presented. A printer 20 of the second embodiment is provided in advance with a frequency table that associates a plurality of vibration frequency ranges wherein the tolerance range ER2 is divided into a plurality of ranges, with the first frequency F1 and the second frequency F2 for each vibration frequency range. The memories in each of the ink cartridges in the second embodiment contain rank information indicating the vibration frequency range wherein the natural frequency HE is included in the ink end state in the individual ink cartridge. The printer 20 determines the frequency of the driving signal based on the rank information that is stored in the memory for the cartridge to be processed, and based on the rank table. Note that the system structure in the second embodiment is identical to that in the first embodiment.

B1. Frequency Table:

The frequency table 43*a* will be explained. FIG. 12 illustrates an explanatory diagram of a frequency table 43*a* in the second embodiment. The frequency table 43*a* includes vibration frequency ranges and driving signal frequencies. The vibration frequency ranges show small ranges wherein the tolerance range ER2 is divided essentially equally. The ranks are identification information for identifying each of the small ranges.

The driving signal frequencies are associated with "ranks," and include the first frequency F1(*n*) and the second frequency F2(*n*). The first frequency F1(*n*) indicates the frequency of the driving signal DS1, and the second frequency F2(*n*) indicates the frequency of the driving signal DS2. The first frequency F1(*n*) is calculated to the application of Equation 6, below. Note that in the second embodiment, n indicates a rank of A through. For example, the first frequency F1(B) indicates the frequency of the driving signal DS1 of rank B. Moreover, in each of the equations below, the maximum vibration frequency HE(n) max indicates the maximum value of the vibration frequency range for each rank. For example, the maximum vibration frequency HE(c) max indicates the maximum vibration frequency in the vibration frequency range for the rank C, where, as shown in the frequency table 43*a*, the maximum vibration frequency HE(c) max=FCmax.

$$\text{First frequency } F1(n)=\text{round}((\text{maximum vibration frequency } HE(n)\text{max}-\alpha\%)\times\{1/(2k+1)\}) \quad \text{(Equation 6)}$$

In the second embodiment, k=1, so the driving signal frequency F is able to be expressed as shown in Equation 7, below:

$$\text{First frequency } F1(n)=\text{round}((\text{maximum vibration frequency } HE(n)\text{max}-\alpha\%)\times 1/3) \quad \text{(Equation 7)}$$

The second frequency F2(*n*) is calculated through the application of Equation 8, below.

$$\text{Second frequency } F2(n)=\text{round}((\text{maximum vibration frequency } HE(n)\text{max}-\beta\%)\times 1/3) \quad \text{(Equation 8)}$$

The first frequency Fn1 and the second frequency Fn2 are calculated in this way. In the second embodiment, each of the frequencies is shown by codes instead of by numerical values for convenience in the explanation, as shown in the frequency table 43*a*. For example, the first frequency F1(*c*) of rank C is expressed as "Fc1 (kHz)" and the second frequency F2 of rank C is expressed as "Fc2 (kHz)." The frequency table 43*a* is stored in advance in the memory 43 of the printer 20.

B2. Determining the Driving Signal Frequencies:

An explanation will be given regarding determining the driving signal frequencies in the second embodiment. Instead of the frequency information in the first embodiment, one of the rank information "A" through "E" is stored in the memory for the cartridge to be processed. The rank information indicates a vibration frequency range that includes the natural frequency HE in the ink end state for the cartridge to be processed.

The CPU 41 of the main controller 40 acquires the rank information from the memory 130 of the cartridge to be processed, through the sub controller 50. The CPU 41 determines the frequency of the driving signal based on the rank information that has been obtained and on the frequency table 43*a* that is stored in the memory 43 of the main controller 40. Specifically, the CPU 41 references the frequency table 43*a* to obtain the first frequency F1(*n*) of the driving signal DS1 and the second frequency F2(*n*) of the driving signal DS2 associated with the rank that matches the acquired rank information. For example, if the acquired rank information is "D", then the CPU 41 obtains, from the frequency table 43, the first frequency F1(D)=Fd1 (kHz) and the second frequency F2(D) =Fd2 (kHz) associated with the rank "D".

In the second embodiment, the first frequency F1(*n*) is a frequency that is calculated based on the natural frequency when there is no change in the natural frequency of the sensor, and the second frequency F2(*n*) is a frequency that is near to the natural frequency after the change if there is a change in the natural frequency of the sensor. In the second embodiment, as with the first embodiment, the amount of ink is determined using the first vibration frequency VF1 that is measured after the driving signal DS1 of the first frequency Fn1 has been provided and the second vibration frequency VF2 that is measured after the driving signal DS2 of the second frequency Fn2 has been provided. In this way, it is possible to improve the accuracy of the amount of ink that is determined, even when there has been a change in the natural frequency.

In the printer in the second embodiment, the first frequency and second frequency are defined uniquely for each rank. Consequently, by preparing in advance driving signals of 10 types for the driving signals DS1 (five different types in the second embodiment) for the number of ranks in the frequency table 43*a*, and for the driving signals DS2 (five different types) that are less than the driving signals DS1 with a fixed ratio, it is possible to reduce the load of implementing the various calculations in generating the driving signals. Consequently, the processing time is able to be compressed while still maintaining excellent detection accuracy in the response signal.

Given the printer in the second embodiment, only rank information is stored in the frequency information 135, thus reducing the amount of memory used of the memory that stored in the ink cartridge, making it possible to use the memory capacity efficiently.

C. Modified Embodiment (1) Although in the first embodiment described above, the frequency information 135 included the natural frequency in the ink end state at the time of manufacturing of each of the ink cartridges, instead a first frequency that is lower, by the constant ratio ($\alpha$%) than the natural frequency in the ink end state at the time of manufacturing of the piezoelectric element of the ink cartridge, and/or a second frequency that is lower, by a fixed ratio ($\beta$%) (where $\beta>\alpha>0$) than the natural frequency in the ink end state may be included. Doing so makes it possible to calculate the first frequency and the second frequency, respectively, using simple calculations from the information included in the frequency information 135.

(2) While in the second embodiment, described above, the vibration frequency (HE) range, the first frequency F1(*n*), and the second frequency F2(*n*) were included in the frequency table 43*n*, alternatively, the frequency table 43*a* may contain the vibration frequency ranges alone. Because the first frequency and the second frequency is able to be calculated using the vibration frequency range, this modified example makes it possible to conserve the memory space in the memory 43.

While in the first embodiment, described above, a first vibration frequency VF1 measurement process and a second vibration frequency VF2 measurement process were implemented and a determination process for the measurement results was implemented based on these measurement results. Instead, if, for example, the result of the first vibration frequency measurement process is that the first vibration frequency VF1 is near the natural frequency H2, then the main controller 40 may determine that printing material of less than the specific amount is stored in the cartridge being processed, and may skip the processes for providing the second driving signal and for measuring the second vibration frequency. On the other hand, if the result of the first vibration frequency measurement is that the first vibration frequency VF1 is near to the natural frequency H1, then the main process unit 40 may implement the measurement of the second vibration frequency VF2, and may determine whether the printing material stored in the printing material container is less than the specific amount depending on whether the second vibration frequency VF2 is near to the natural frequency H2 or near to the natural frequency H1.

As explained in the first of embodiment, above, the case wherein the vibration frequency is measured incorrectly is the case of the ink end state, and thus the main controller 40 in the present embodiment determines that the amount of ink that is stored in the cartridge being processed is less than the specific amount if the first vibration frequency VF1, originally measured, and/or the second vibration frequency VF2 is near to the target natural frequency H2. Consequently, in this modified example a determination as to whether the first vibration frequency VF1 is near to the natural frequency H2 is made prior to measuring the second vibration frequency VF2, and if the first vibration frequency VF1 is near to the natural frequency H2, then it is determined that the ink that is stored in the cartridge being processed is less than the specific amount, and the measurement of the second vibration frequency VF2 is not implemented. The present modified example makes it possible to compress the processing time while maintaining the accuracy of the determination of the amount of ink because the second vibration frequency measurement process is not implemented if the first vibration frequency VF1 is near to [the natural frequency] H2.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing material amount determining method implemented by a printer, wherein a printing material container is attached removably to the printer and comprises a detector and a memory, wherein the detector detects an amount of a printing material stored using a piezoelectric element, wherein the memory stores frequency information regarding a frequency of a driving signal for driving the detector, the method comprising:

acquiring the frequency information from the memory;

acquiring a first frequency and a second frequency based on the acquired frequency information, wherein the first frequency is lower, by a fixed ratio, than a first natural frequency that is the natural frequency of the detector when the amount of printing material stored in the printing material container is less than a specific amount of printing material, wherein the second frequency is lower than the first frequency;

providing a first driving signal and a second driving signal to the piezoelectric element with different timings, wherein the first driving signal has the first frequency and the second driving signal has the second frequency;

detecting a first response signal and a second response signal, wherein the first response signal is outputted from the detector in accordance with vibration of the piezoelectric element after the provision of the first driving signal stops, and the second response signal is outputted from the detector in accordance with vibration of the piezoelectric element after the provision of the second driving signal stops;

measuring a first vibration frequency included in the first response signal and a second vibration frequency included in the second response signal; and determining the amount of the printing material stored in the printing material container based on at least one of the first vibration frequency and the second vibration frequency.

2. A printing material amount determining method implemented by a printer, wherein a printing material is stored in a printing material container, wherein the printing material container is attached removably to the printer, wherein the printing material container comprises a detector and a memory wherein the detector detects an amount of the printing material stored in the printing material container using a piezoelectric element, wherein the memory stores a first frequency and a second frequency, wherein the first frequency is lower, by a fixed ratio, from a natural frequency of the detector, and the second frequency is lower than the first frequency, when less than the specific amount of printing material is stored in the printing material container, the method comprising:

acquiring the first frequency and the second frequency from the memory;

providing a first driving signal and a second driving signal to the piezoelectric element with different timings, wherein the first driving signal has the first frequency and the second driving signal has the second frequency;

detecting a first response signal and a second response signal, wherein the first response signal is outputted in accordance with the vibration of the piezoelectric element after the provision of the first driving signal stops, wherein the second response signal is outputted in accordance with the vibration of the piezoelectric element after the provision of the second driving signal stops;

measuring a first vibration frequency of the piezoelectric element and a second vibration frequency of the piezoelectric element, wherein the first vibration frequency is included in the first response signal, wherein the second vibration frequency is included in the second response signal; and determining the amount of the printing material stored in the printing material container based on at least one of the first vibration frequency and the second vibration frequency.

3. A printing material amount determining method implemented by a printer, wherein a printing material is stored in a printing material container, wherein a printing material container is attached removably to the printer, wherein the printing material container comprises a detector and a memory, wherein the detector detects an amount of the printing material stored in the printing material container using a piezoelectric element, and the memory stores frequency information regarding the frequency of a driving signal for driving the detector, the method comprising:

acquiring the frequency information from the memory;

acquiring a first frequency and a second frequency based on the acquired frequency information, wherein the first frequency is 1/(2k+1) times (where k is any given positive integer greater than 0) a vibration frequency that is lower by $\alpha$% (where $\alpha>0$) than a reference natural frequency, wherein the reference natural frequency is the natural frequency of the detector when the amount of the printing material stored in the printing material container is less than a specific amount, wherein the second frequency is 1/(2k+1) times a vibration frequency that is lower by $\beta$% (where $\beta>\alpha>0$) than the reference natural frequency;

providing a first driving signal and a second driving signal to the piezoelectric element with different timings, wherein the first driving signal has the first frequency and the second driving signal has the second frequency;

detecting a first response signal and a second response signal, wherein the first response signal is outputted from the detector in accordance with the vibration of the piezoelectric element after the provision of the first driving signal stops, wherein the second response signal is outputted from the detector in accordance with the vibration of the piezoelectric element after the provision of the second driving signal stops;

measuring a first vibration frequency and a second vibration frequency, wherein the first vibration frequency is included in the first response signal and the second vibration frequency is included in the second response signal; and determining the amount of the printing material stored in the printing material container based on at least one of the first vibration frequency and the second vibration frequency.

* * * * *